US006290090B1

(12) United States Patent
Essebaggers

(10) Patent No.: US 6,290,090 B1
(45) Date of Patent: Sep. 18, 2001

(54) DRIP-LESS CARBONATED BEVERAGE CONTAINER "FLOW CONTROL ELEMENT" WITH SUCTION SPOUT

(75) Inventor: Jan Essebaggers, Nieuwerkerk (NL)

(73) Assignee: ENPROS Holding B.V. (NL)

( * ) Notice: Subject to any disclaimer, the term of this patent is extended or adjusted under 35 U.S.C. 154(b) by 0 days.

(21) Appl. No.: 09/585,660

(22) Filed: Jun. 1, 2000

(51) Int. Cl.[7] ..... B65D 41/00

(52) U.S. Cl. ..... 220/710; 220/705; 220/714

(58) Field of Search ..... 220/710, 703, 220/705, 711, 714, 717

(56) References Cited

U.S. PATENT DOCUMENTS

| | | | | |
|---|---|---|---|---|
| 4,579,257 | * | 4/1986 | Brandlein | 220/717 X |
| 5,282,541 | * | 2/1994 | Chen | 220/705 X |
| 5,462,194 | * | 10/1995 | Barnwell | 220/705 X |
| 5,651,471 | * | 7/1997 | Green | 220/705 X |
| 5,908,126 | * | 6/1999 | Wang | 220/705 X |
| 6,079,586 | * | 6/2000 | Hanneman | 220/703 X |
| 6,123,219 | * | 9/2000 | Cornell et al. | 220/705 |

* cited by examiner

*Primary Examiner*—Steven Pollard
(74) *Attorney, Agent, or Firm*—Jan Essebaggers

(57) ABSTRACT

The invention relates to a "flow control element" with suction spout for (metal) carbonated beverage cans (canteens), cups or handheld containers that hold temporarily a carbonated fluid or hot drink under pressure and that is closed off with a leak proof cover. Spilling of the fluid held therein is prevented during awkward drinking situations such as in cars while driving, walking or other less controlled drinking situations. The fluid in a beverage can, remains under pressure of the carbonation process while access is possible through the subject flow control element when a suction is applied to the spout. For non pressurized fluids an air inlet vent is provided to prevent the suction of a vacuum in the container, thereby reducing the fluid flow while drinking. In all situations and position of the container no spilling of the fluid is possible. The spout is permanently attached to the lid of the container, in case of an aluminum beverage can, or may be both removable when used for a drinking cup or handheld container. The spout is leak tight attached to a housing enclosure that holds a spring, a centrally perforated membrane, a hollow valve stem and a valve. This housing enclosure extends into the inside of the container, which extended part functions as a guide for the valve stem and that incorporates the valve seat. The hollow valve stem is attached to the perforated membrane on one side and to the valve on the other side. When suction is applied to the spout, the membrane moves the valve and opens a flow path, thereby allowing fluid to flow through the valve stem and the perforated membrane to the mouth. When the suction stops, a spring closes the valve against the gas pressure in the can or container. The fluid opening to the valve extends through a flexible tube to the bottom of the container to allow emptying of the container completely. An air vent is provided, when the internal gas pressure sinks below the atmospheric pressure.

13 Claims, 4 Drawing Sheets

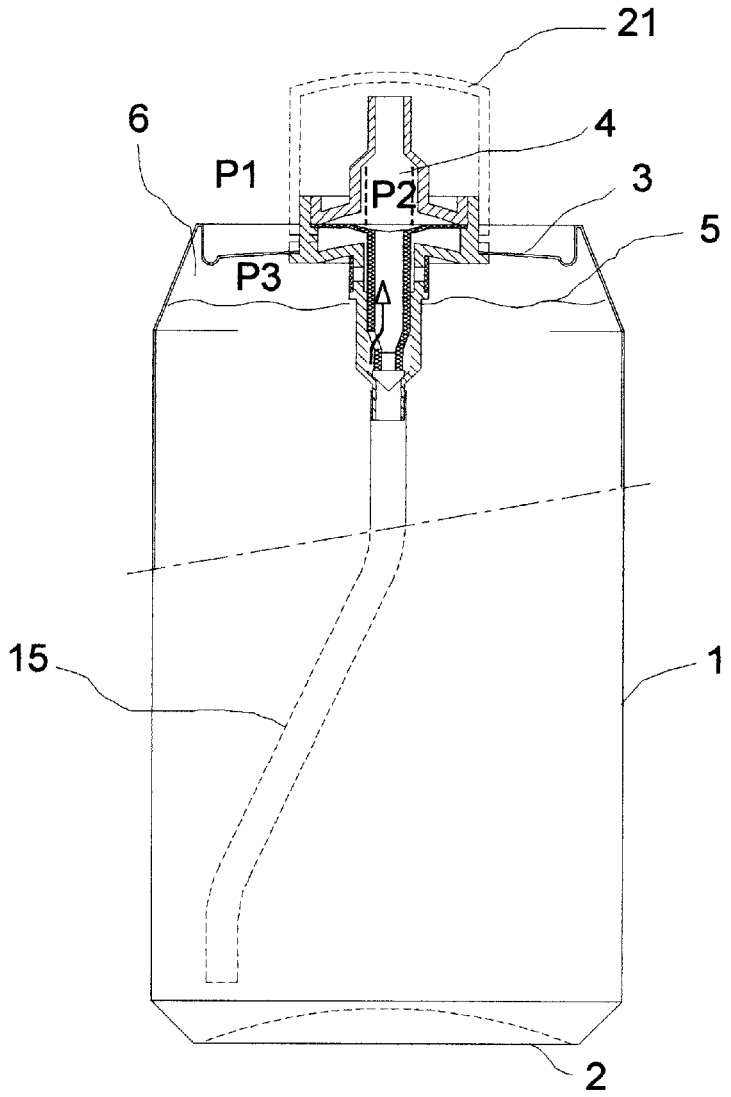
FIG. 3
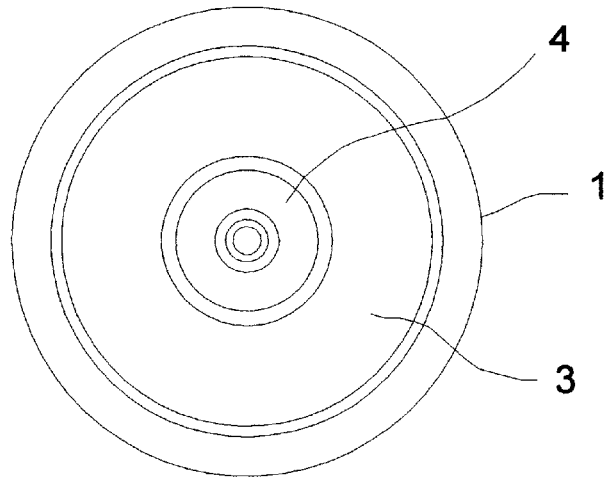

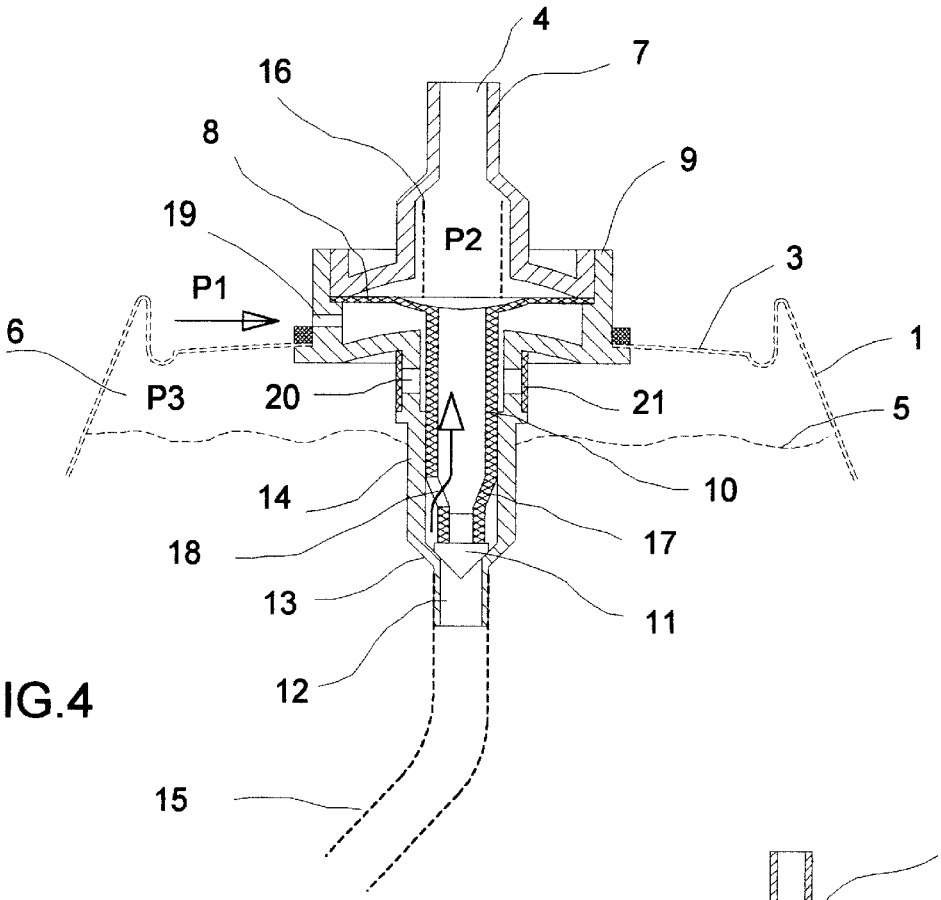
FIG.4
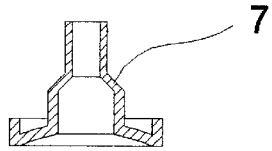
FIG. 5-a
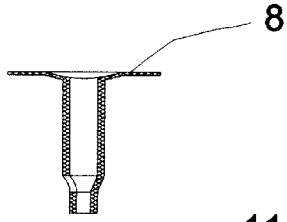
FIG. 5-b
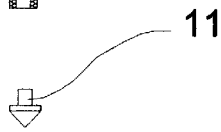
FIG. 5-c
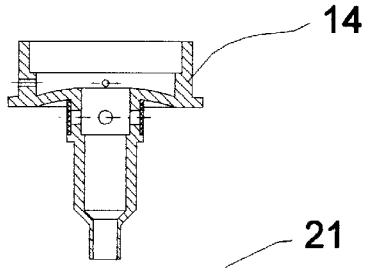
FIG. 5-d
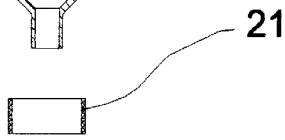
FIG. 5-e

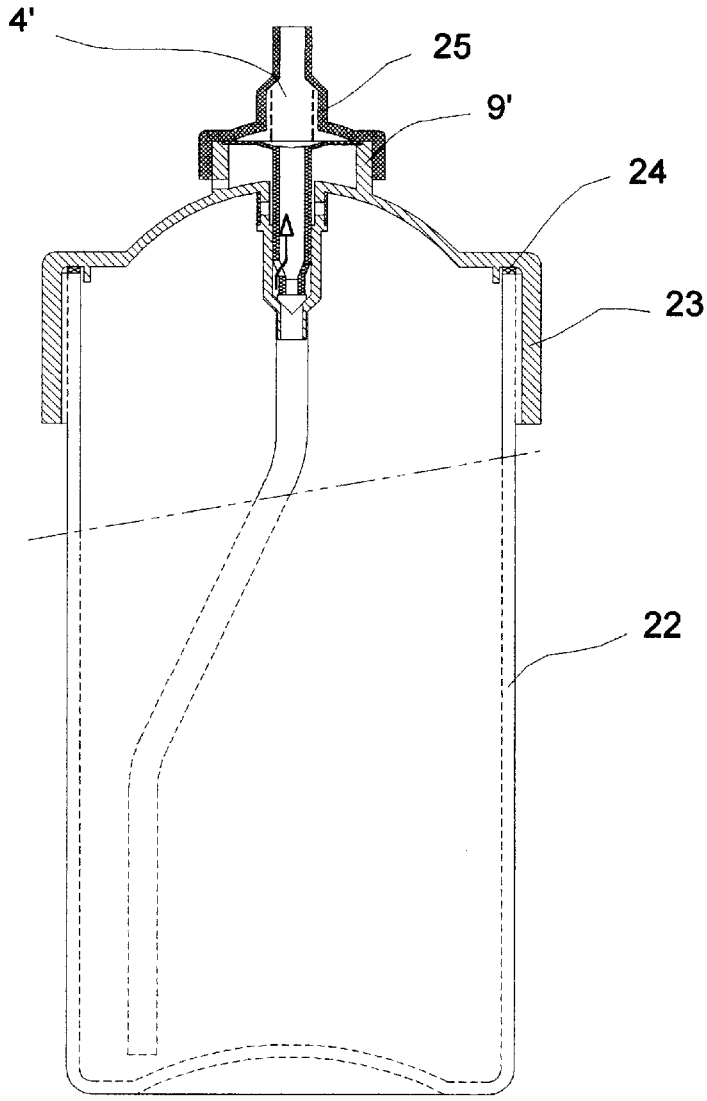
FIG. 6
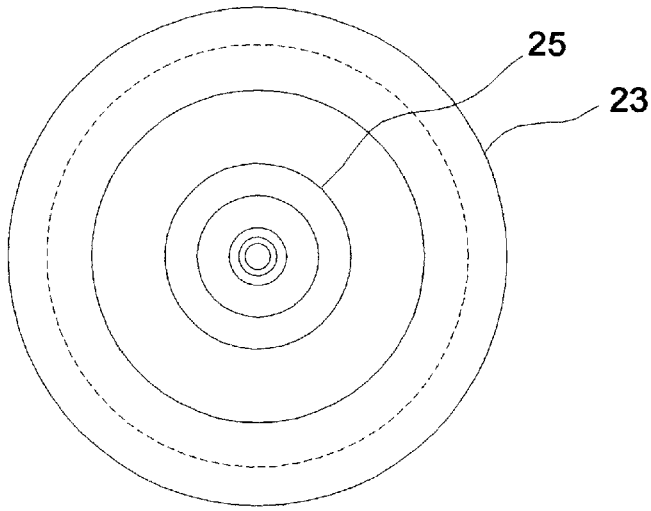

DRIP-LESS CARBONATED BEVERAGE CONTAINER "FLOW CONTROL ELEMENT" WITH SUCTION SPOUT

OBJECT OF THE INVENTION

Carbonated beverages are supplied in aluminum cans, bottles or other containers for consumption. As soon as the can or bottle is opened, the fluid starts deteriorating and becomes flat in short time thereafter. If supplied in bottles, the beverage is normally poured into a cup for immediate drinking, while the rest is kept under pressure in the bottle for future use by a screw cap. Aluminum cans, however, are commonly opened by pulling away a peace of the top closure and cannot be closed thereafter. This means that the fluid needs to be consumed more or less immediately after opening. Also when poured from a bottle into a cup the amount may be too much for immediate consumption and someone may want to use it over an extended period of time. In prior art solutions it became apparent that no pressure can be maintained in a so called non spilling cup or handheld container and does not prevent spilling of fluid, while in action with carbonized or hot fluids.

The object of the invention is thus maintaining the beverage carbonized in a container that is in use, while access to the fluid is easy and spilling is prevented during motion, under all positions of the container. The same applies for hot drinking fluids, thereby keeping the fluid inside the cup or container, while the air pressure rises due to expansion of the enclosed air.

BACKGROUND OF THE INVENTION

Drinking cups and handheld containers with leak tight top-covers, combined with dripless spout and air vent are provided throughout the years in many shapes and forms, in order to prevent spilling of the liquid, contained therein for temporarily storage. The spout and vent are provided with valves that enable fluid to be withdrawn from the container or cup, when suction is applied to the spout. The reduction in fluid content in the container is replaced by air that flows through a second opening in the cover. This air vent holds a control valve that opens when the pressure sinks below the atmospheric outside pressure, due to the suction action at the spout. As an example; a drip less feeding training container of this nature has been described by Belanger in U.S. Pat. No. 5,079,013; U.S. Pat. No. 5,542,670 by Morano; U.S. Pat. No. 5,186,347 by Freeman etc. For all these inventions the application was primarily made for babies and toddlers with the objective of eliminating spillage of the fluid by throwing over the cup or container and while drinking during movement. In the above patent descriptions other references are made to other inventors, all with the same or similar goals in mind of eliminating spillage of fluid.

The thus described applications are suitable for non-carbonized fluids and cold drinks only. If carbonized fluids are applied, the pressure in the container will built-up thereby pushing the valve open and leakage and spilling is not prevented. The same applies for hot drinking fluids, whereby the air above the fluid is heated and expands, causing the pressure in the container to rise and will push out the fluid, if not held in the upright position. Spilling could be prevented, however, by using a stronger resilient valve material in the case of Morano U.S. Pat. No. 5,542,670 or a stronger spring in the case of Belanger, U.S. Pat. No. 5,079,013. The draw back, however, is that suction to the spout has to increase appreciably, even beyond human capacity and opening of the valve would be impossible or at least cumbersome.

For beverage cans, as nowadays are commonly available to the consumer with carbonized drinking fluids, adapters are provided that clips onto the top of the can to close off the beverage can after opening and/or make drinking easier than directly from the can. Such features are provide for in the following descriptions: U.S. Pat. No. 4,796,774 by Nabinger; U.S. Pat. No. 4,852,776 by Patton; U.S. Pat. No. 4,883,192 by Krugman; U.S. Pat. No. 5,071,042 by Esposito, U.S. Pat. No. 5,947,324 by Palinchak, EP 0870 685 A1 by Igor etc. These applications have the disadvantage that the pressure is immediately released from the can after opening and in the shortest possible time the carbon dioxide is released from the fluid and becomes flat and much less attractive to drink.

This means that all previous described applications are not suitable for carbonized beverages or hot drinking fluids.

The present invention overcome all these problems as well as for beverage cans as for closed non-spilling drinking cups combining a number of advantages over prior art solutions, in the same application being: Maintaining the gas pressure to keep the fluid carbonized; easy transport of partially filled containers and no fluid is spilled while drinking and used in action. For the beverage can the present invention has an additionally advantage of being more hygienic than using a beverage can closure and/or drinking adapter as provided for in e.g. U.S. Pat. No. 4,883,192 of Krugman and other inventions thereafter.

BRIEF SUMMARY OF THE INVENTION

The present invention comprises a flow control element with a spout for sucking fluid from a pressurized cup, metal beverage can or handheld container, whereby the fluid is a carbonized beverage or hot drink such as coffee or tea. The flow control element is activated by sucking on the spout, whereby a membrane type element lifts a valve that closes off the inside of the container from the outside. The inside of the container normally has a higher gas pressure than the atmospheric outside pressure caused by the carbonized fluid or expanding air that is heated by a hot drinking fluid within the confinement of the drinking cup. The flow control element comprises a spout, gas tight connected to a housing, a spring, a centrally perforated membrane shape element connected to a valve stem, which is hollow in nature to enable fluid to flow from the container to the spout through the opening in the membrane; a valve stem guide with valve seat, which is an extrude part of the housing and a valve of soft resilient material. The valve is held firmly in the closed position by a spring that pushes onto the membrane and valve stem, towards the valve seat. As the valve is connected through the valve stem with the membrane, movement of the membrane in axial direction, results in the same movement of the valve. By reducing the pressure on one side of the membrane by suction on the spout, the membrane will displace the valve thereby opening up the inside of the container and allowing fluid to flow. The fluid flows from the container through a thin flexible tube in the form of a straw inside the container, that reaches from the bottom of the container to the valve opening, through the valve stem, through the membrane into the spout to the mouth. The valve closing area is substantially smaller than the active surface area of the membrane. A small suction pressure difference over the membrane will result in a relative large force to open the valve against the pressure of the spring, that normally keeps the valve closed. The combination of the valve, spring and membrane is therefore an essential part of the invention enabling the flow control element to work. The housing of the flow control element is either gas tight fit in a hole in the cover of an aluminum beverage can or is an integral part of a gas tight cover of a drinking cup. The lower side of the membrane is held at atmospheric pressure by an opening in the housing of the flow control element. When the pressure in the can or cup sinks below atmospheric pressure by the reducing fluid level, an air vent is provided in the valve guide, that only opens when this is the case, to replace the reduced fluid amount.

By so described, the flow element closes off the inside of the handheld container from the outside under all circumstances and position of the container when not in use for drinking.

BRIEF DESCRIPTION OF THE DRAWINGS

The following accompanying drawings of two preferred embodiments will clarify all features of the present invention to those skilled in the art of reading the drawings and accompanying specification.

FIG. 3 is a partial cross-sectional view and a top view of the first preferred embodiment showing all parts required for the flow control element of the invention FIG. 4 shows a cross-section of an enlarged part of FIG. 3, for better view of the assembly of the flow control element FIGS. 5-*a*) through 5-*e*) Shows cross-sections of the individual parts that make-up the flow control element of the invention FIG. 6 Shows a partial cross-section with top view of a non-spilling drinking cup of the second embodiment of the invention of which FIG. 2 shows a perspective view.

DETAILED DESCRIPTION OF THE INVENTION

With reference to the drawings, the invention will be described for application with a carbonized beverage can (teen), commonly available for consumption, however, with a modified top cover, adjusted for accommodation of the flow control element subject of the present invention.

Figure 1:
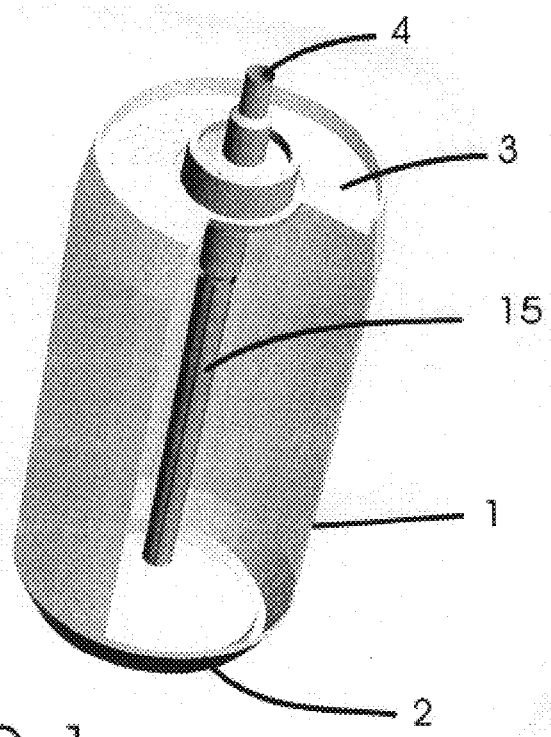
FIG. 1 is a perspective view of an assembled beverage can, that embodies one of the preferred embodiment of the present invention. Further details of this embodiment are shown in FIGS. 3, 4 and 5

FIG. 1 shows a partially opened-up, outside perspective view of a beverage can with a centrally located flow control element in the top cover, extending from the outside to the inside of the can, of the first preferred embodiment. Details of this embodiment are shown in a partially cross-sectional drawing of FIG. 3, while FIG. 4 shows an enlarged cross section of the flow control element, for clarification. The beverage can enclosed by a cylindrical wall 1, a bottom 2, a top cover 3 and a flow control element 4 holds a carbonized beverage 5 that remains under a gas pressure (P3) 6 by the carbonization process. This gas pressure can be substantially higher than the outside atmospheric pressure (P2) to keep the beverage carbonized for the pleasure of drinking the fluid. The flow control element 4 maintains this gas pressure as long as needed, while access to the fluid in the can remains possible. This is accomplished by a housing 9 that fits tightly into the upper cover 3 of the beverage can and forms part of the barrier between the inside and outside of the can. A spout 7 is gas tight connected to this housing and keeps a centrally perforated membrane 8 in place, that fits on the suction side gas tight into the housing 9, while on the other side an atmospheric pressure is maintained. Above and below the membrane, adequate space is available to allow the membrane to move a few millimeters up and down at the center area, while fixed at the periphery. The membrane 8 is integrally connected to a valve stem 10, while the valve stem is hollow in nature for allowing the fluid to pass through, while also the membrane has a central hole at which location the valve stem is gas tight connected to the membrane. The valve stem 10 fits into the lower cylindrical part 14, acting as a valve stem guide, forming an integral part with housing 9, providing little clearance between these parts. This clearance is slide fit, allowing movement of the valve stem on one side but being tight enough, not to allow fluid or gas to pas through. The lower part of the valve stem guide 14 holds also the valve seat 13. On the lower side of the valve stem, a valve 11 of resilient material, is held in place that closes off the access opening 12 to the valve seat 13, to the inside of the beverage can. In order to enable emptying the can completely, a flexible tube (straw) 15 is used, that is tightly fixed to the valve opening 12 and reaches down to the bottom of the can. The valve is closed by a spring 16 on the suction side of the flow control element, that pushes the membrane 8 and therewith the valve 11 to its rest position. The hollow valve stem is narrowed down in the lower part 17, while in this tapered section one or more holes 18 are made, through which the fluid passes when the valve 11 is lifted from its seat 13. A small air passage 19 is provided in the housing 9 to assure that the back pressure on the lower side of the membrane remains atmospheric (P1).

The flow control element 4 is thus activated: Suction by mouth to the spout 7 will move the membrane 8 upwards, thereby lifting the valve from its seat against the spring pressure. The magnitude of the force to activate the valve can be determined from the pressure difference over the membrane times the active surface area of the membrane, which is (P1–P2)×A. The active surface area "A" being $\frac{1}{4}.\pi.d^2$ in which "π" (pi) is 3.14 and "d" is the active membrane diameter. When the valve is lifted from its seat, the fluid in the can will be forced outwards by the pressure difference P3–P2, which is respectively the gas pressure in the can and the suction pressure in the spout. When suction is applied, the fluid flows through the flexible tube 15 to nozzle 12, passes the valve 11, through the hole(s) 18 into the hollow valve stem 10 to the upper side of the membrane 8 into the spout 7, to the mouth. As soon as the suction action stops, the pressure difference (P1–P2) ceases, leaving only the spring 16 pressure left, which will push the valve 11 back to its seat 13 and thus closes off the fluid passage.

Under certain circumstances it is possible that by emptying the can, the internal pressure P3 is substantially reduced and even become less than the atmospheric outside pressure P1. In that case the suction pressure will be able to open the valve, but is not sufficient to empty the beverage can completely. For this situation a vent 20 is provided, which consists of one or more holes in the upper part of the valve stem guide 14. These vents are normally closed off by a rubber band 21 of adequate width to cover the holes completely and which will act as a valve, allowing air to pass from the air passage 19 into the area under the membrane, along the upper portion of the valve stem guide through the vent holes 20 into the can. This feature will take care that the inside pressure P3 of the can will never drop substantially below atmospheric outside pressure P1. The upper portion of the valve guide 14 is therefore slightly enlarged to allow air to pass-by. For the application of the flow control element for beverage cans as described above, a hygienic cap 21 is provided that tightly fits onto the shoulder of housing 9 to keep the spout from getting dirty during transport and when not in use.

In FIGS. 5-*a*) through 5-*e*) the individual parts are drawn that makes up the flow control element as described of the first preferred embodiment. This embodiment, however, is not meant to limit the invention to other configurations, whereby the same principle of force enlargement is applied by using a perforated membrane that activate a valve.

Figure 2:
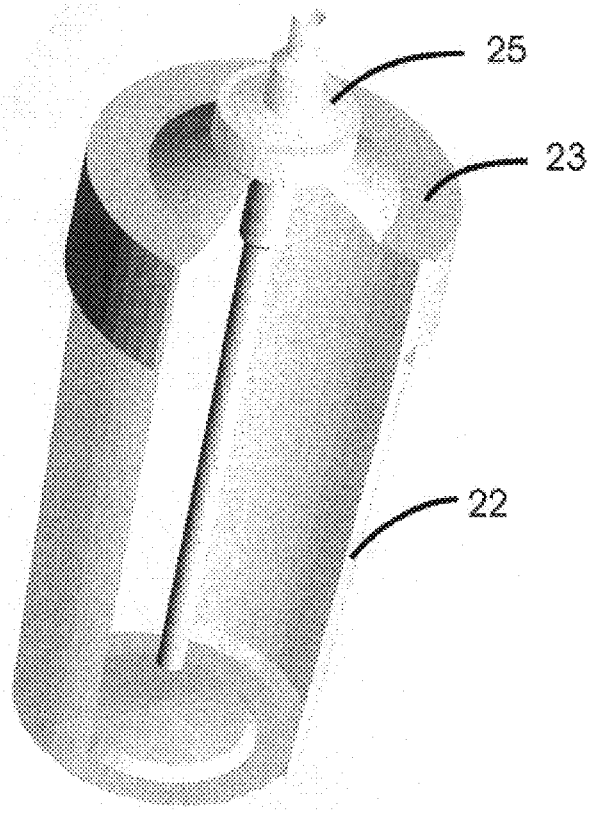
FIG. 2 is a perspective view of an assembled non-spilling drinking cup or container of a second embodiment of the invention of which further details are shown in FIG. 6

In FIGS. 2 and 6 another preferred embodiment is shown in applying a flow control element to a non spilling drinking cup, whereby the top cover is tightly screwed onto the cup or container. In this case the housing 9' of the flow control element 4' is an integral and leak tight element of the top cover, whereby the cup can be filled with carbonized beverages, hot and cold drinks without spilling after closure. In the case of hot drinks, the air above the fluid will expand, building up pressure in the cup or handheld container. For this application a perspective view of a partly opened cup or container is shown in FIG. 2, while a partial cross-section of the same embodiment is shown in FIG. 6. As the principle of operation of the flow control element 4 for this application, is exactly the same as described for the first preferred embodiment, this part will not be repeated and only the changes will be described.

FIG. 6 applies to a metal or plastic container 22, with a removable top cover 23 that is screwed onto the container 22 and having a gas tight seal of resilient material 24, preventing the container from leaking when filled with a beverage, hot or cold drink. In this second embodiment, the housing 9' of the flow control element 4' is now integrally molded with the top cover 23, thereby differing slightly from the flow control element of the beverage can. The spout 25 is removable to provide access to the inside of the flow control element for cleaning purposes. The remaining parts are substantially the same as used for the (aluminum) beverage can of FIGS. 1,3,4 and 5.

What I claim as my invention is:

1. A drip-less "flow control element" for emptying a hand held carbonized beverage can, whereby the gas pressure above the fluid is maintained within the can, while no liquid is spilled during drinking the fluid from the can and while in motion, comprising:

a) a handheld liquid container means for temporarily storing a carbonized beverage or liquid under gas pressure;

b) said container means provided with a hermetically sealed off top cover;

c) said top cover holds said flow control element that fits hermetically sealed within said top cover;

d) said flow control element comprising a spout, connected to a housing on the outside of said container top-cover with an extruded tubular portion to the inside of said container, which housing holds a spring loaded membrane connected via a hollow valve stem to a valve that blocks off the fluid flow from said container and that holds the gas pressure within the container when not in use;

e) said membrane is centrally perforated for the fluid to pass and that opens a valve when the user sucks on the spout, thereby providing a passage for the liquid in said container to flow to the mouth;

f) said spring loaded membrane has an active surface area substantial larger than the flow area of the valve;

g) said membrane connected to a valve through a hollow valve-stem that fits closely in said tubular shaped extruded portion of said housing, allowing the valve-stem to move up and down, while fluid is allowed to pass through the hollow valve-stem, but no fluid is allowed to pass on the outside during drinking from the can or container;

h) said hollow valve-stem holding a valve of resilient material that blocks the fluid flow when closed;

i) said membrane is spring loaded in order to close the valve when the suction force on the membrane ceases and no further liquid is required from the container;

j) said extruded part of said housing having vent holes in the upper part thereof, that connects to the underside of said membrane which is held at atmospheric pressure by providing an air passage in the side of said housing towards the inside of the container;

k) said vent holes are blocked off with an elastic band, closing the vent holes when the gas pressure inside the container, is higher than the atmospheric outside pressure and open the vent holes when by fluid displacement from the container, the gas pressure may drop below atmospheric outside pressure;

l) said extruded part of said housing in which the valve stem moves up and down, having an enlarged inside diameter in the upper portion of said extrude part in order to allow air to flow to said air vents.

2. The drip-less "flow control element" of claim 1 applied for a drinking cup or handheld container for carbonized beverages or hot drinking fluids, comprising a) a container with a removable top-cover b) said top-cover screws gas tight to said container connection in order to enable said flow control element to take apart for cleaning purposes after usage.

3. The drip-less flow control element wherein the spout is removable from the top-cover to open up the inside of the flow control element for cleaning purposes and which can be brought back in place after cleaning.

4. The drip-less "flow control element" of claim 1 wherein the membrane has a wave form shape and being of a strong resilient material that enables to eliminate the spring from the said flow element.

5. The drip-less "flow control element" of claim 3 wherein the membrane of claim 1 being adequately large to open the valve against the resilient force of said membrane or separately applied spring above the membrane by the suction pressure of the mouth.

6. The drip-less "flow control element" of claim 1 wherein the valve has a globular shape of a relative soft resilient material in relation to the material used for said valve stem and valve seat.

7. The drip-less flow control element of claim 1 wherein pressure force of the spring or the resilient force of the membrane is adequately strong to resist the inside gas pressure on the valve, while adequate flow area is provided for flow passage from the inside of the container to the spout.

8. The drip-less "flow control element" of claim 1 wherein the beverage can is made of metal or plastic material that can hold a drinking fluid under gas pressure or at elevated temperature.

9. The drip-less flow control element of claim 1 wherein the vent holes are closed off with an elastic band at the upper side of the extrude part of said housing, can be eliminated in case the inside gas pressure will always be above the atmospheric outside pressure.

10. The drip-less flow control element of claim 1 wherein the membrane comprises a spring loaded piston instead, that fits gas tight within a cylindrical housing of the flow control element.

11. The drip-less flow control element of claim 1 applied to beverage cans, closed drinking cups and handheld containers for all ages including babies, toddlers, teenagers and seniors.

12. The drip-less flow control element of claim 1 eccentrically placed on a drinking cup or handheld container.

13. The drip-less flow control element of claim 1 of described nature used in other applications, whereby fluid under gas pressure is withdrawn from a container by suction on a flow control element.

* * * * *